United States Patent [19]

Lautenschläger

[11] 4,091,500

[45] May 30, 1978

[54] CABINET HINGE

[75] Inventor: Gerhard Wilhelm Lautenschläger, Brensbach-Wersau, Germany

[73] Assignee: Karl Lautenschläger KG Möbelbeschlagfabrik, Reinheim, Odenswald, Germany

[21] Appl. No.: 791,772

[22] Filed: Apr. 28, 1977

[30] Foreign Application Priority Data

Jul. 31, 1976 Germany .....2634558

[51] Int. Cl.[2] ..... E05D 11/10

[52] U.S. Cl. ..... 16/145; 16/163; 161/164

[58] Field of Search ..... 16/164, 163, 159, 145, 16/180, 182, 183

[56] References Cited

U.S. PATENT DOCUMENTS

| | | | |
|---|---|---|---|
| 3,864,786 | 2/1975 | Salice | 16/163 |

FOREIGN PATENT DOCUMENTS

| | | | |
|---|---|---|---|
| 2,005,853 | 12/1969 | France | 16/164 |
| 2,439,314 | 2/1976 | Germany | 16/145 |
| 2,432,150 | 1/1976 | Germany | 16/145 |
| 2,150,409 | 4/1973 | Germany | 16/159 |
| 2,457,022 | 6/1976 | Germany | 16/159 |

*Primary Examiner*—James Kee Chi

[57] ABSTRACT

A cabinet hinge having a two-piece door part which is constructed as an inlet housing composed of an outer, cup-shaped housing piece which can be fastened in a mating inlet in a cabinet door, and a separately made insert piece which can be fitted into the outer housing piece and snap-fastened therein and which is pivotingly linked to the supporting wall part of the hinge. Within the insert piece there is integrated a known over-center mechanism formed of a spring-biased tongue cooperating with a countersurface, whose spring mounted in the insert piece engages at its extremity remote from the tongue a locking element which is displaceably mounted on the insert piece and which is provided with at least one, preferably two, catch projections which, when the insert piece is in its proper position in the outer housing piece, catch in recesses provided in the latter.

7 Claims, 7 Drawing Figures

FIG.1
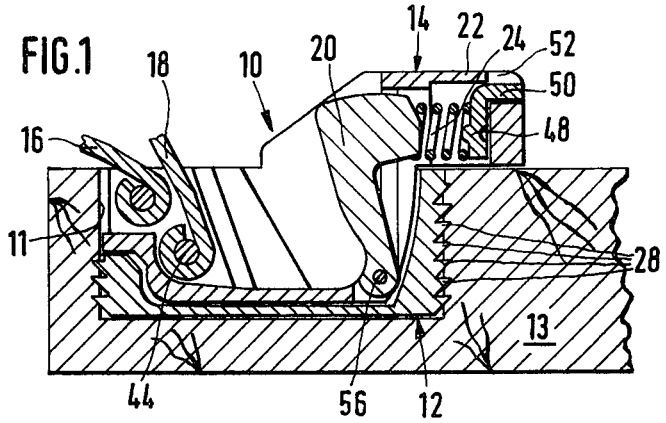
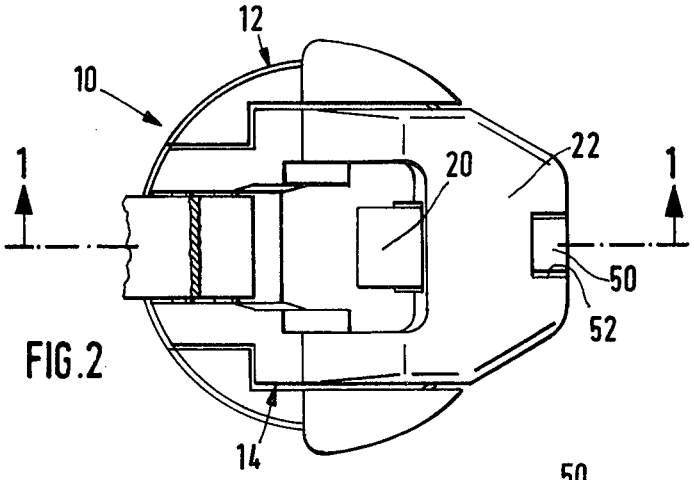
FIG.2
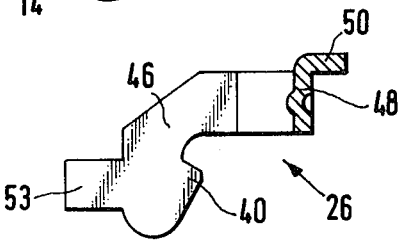
FIG.6
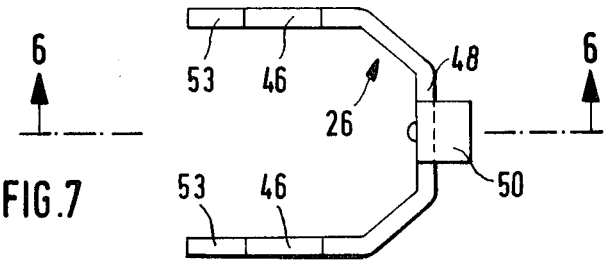
FIG.7

CABINET HINGE

BACKGROUND

The invention relates to a cabinet hinge having a two-piece door part articulated to the supporting wall part and composed of a cup-like outer housing piece which can be fastened in a mating inlet in a cabinet door, and of a separately made insert piece which can be inserted matingly into the outer housing part and snap-fastened therein.

In hinges constructed in this manner, the outer, cup-like housing piece can be driven separately into mating mortises in the door or can be fastened therein in some other manner, while the inner insert piece, joined pivotingly by hinge links to the supporting wall part, can be installed separately. This has the advantage, for example, that the doors can be equipped at the factory with the outer housing piece of the recessed housing, while the insert piece remains uninstalled. The doors can therefore be stacked for shipment in compact packages. At the furniture dealer's or at the purchaser's house, all that need be done is to snap the insert part into the outer housing part mounted in the door. In the known inlet housings of this kind (German Pat. No. 1,559,940; German Offenlegungsschrift No. 2,052,355), the insert piece is locked in the housing piece by resiliently yielding tongues injection molded on the inner wall of the outer housing piece which engage projecting ridges provided on the insert piece at the correct position. It is disadvantageous in this case that, at least for the outer housing part, a plastic material must be selected which assures sufficient elasticity for the operation of the resilient tongue, and this elasticity must not deteriorate with age. The security of the locking action provided by such tongues is furthermore dependent upon the thickness of the tongues which, on account of the limited space available, cannot be made too thick. For hinges subjected to greater stresses, such as, for example, heavy tall cabinet doors, or hinges subjected to shock loads by an over-center mechanism when they are closed, the known construction is therefore less suitable. Similar considerations apply to another known hinge of the kind involved herein (German Offenlegungs schrift No. 2,143,672), in which the fixation of the inner insert piece in the outer housing piece is accomplished by a bayonet type of lock. Neither has it been possible as yet for such two-piece inlet housing hinges to be made as over-center hinges on account of the greater stress to which they are subject and the small amount of space that is available, even though over-center hinges with one-piece recessed housings are today becoming increasingly popular.

THE INVENTION

The invention therefore has the object of creating a cabinet hinge with a two-piece inlet housing, in which the insert piece can be installed in the outer housing piece and be removed again therefrom just as simply and quickly as it is in the known hinges, and in which the snap-action assembly of the two pieces will withstand greater stress, so that the inlet housing can additionally be provided with an over-center mechanism of compact construction.

Setting out from a cabinet hinge of the kind mentioned in the beginning, this object is achieved in accordance with the invention in that a known over-center mechanism formed by a spring-biased tongue cooperating with a counter-surface is integrated within the insert piece, in which the spring mounted in the insert piece engages at its end farthest from the tongue a locking element mounted displaceably on the insert piece, said locking element being provided with at least one, preferably two, catch projections which, when the insert piece is in its proper position in the external housing part, engages catch recesses provided in the latter. The spring required for biasing the tongue of the over-center mechanism is thus simultaneously used in accordance with the invention for the production of the spring force for the locking element. Thus, resilient tongues of the material of the inlet housing itself can be dispensed with, so that the housing material can be selected exclusively on the basis of its ability to withstand stress. Since the over-center tongues are equipped with relatively strong springs so as to assure a reliable over-center operation even in the case of heavy doors, the spring force applied to the locking element is also so high that it assures that the fixation of the insert piece in the external housing piece will withstand great stress.

If the hinge is constructed as a four-joint hinge, in which the insert piece is articulated to the door part of the hinge in the manner of a quadruple linkage, provision is made in a preferred further development of the invention so that at least one of the hinge pins mounting the hinge links on the door part is made so long that its extremities project at both ends slightly from the insert piece, and that in the external housing piece undercut recesses are provided for receiving the projecting ends when the insert piece is in the proper position in the external housing piece. The lengthened pivot pin thus additionally locks the insert piece in the external housing piece and thus improves the reliability of the fastening.

The locking element is preferably stamped from sheet metal and has an approximate U shape in plan, the limbs of the U being carried flatly on the insert part, while the spring of the over-center mechanism engages the cross-member joining the limbs of the U. The catch projections are then cut on the limbs of the U and point in the direction of the spring force acting on the locking element. The locking element made from sheet metal is on the one hand sufficiently stable and on the other hand requires little space, thereby avoiding an unnnecessary enlargement of the inlet housing to accommodate the interacting locking or snap engagement means.

To enable the insert piece to be separated again from the external housing piece as simply as possible, provision is made in an advantageous further development of the invention for a short tab, bent away approximately at a right angle, is stamped in the cross member of the locking element, and is carried in a recess in the insert piece which is open at least in the vicinity of the free end of the tab for the engagement of a tool whereby the locking element can be pushed back against the action of the spring. By exerting a pressure with a screwdriver or the like on the free end of the tab, the engagement of the locking element with the external housing piece can thus be released without difficulty, whereupon the insert piece can be removed from the housing piece.

In addition to the carrying of the bent-over tab in the recess in the insert piece, it is recommended that the locking element additionally be carried on the insert piece by guiding the free ends of the limbs of the U for longitudinal displacement in shallow recesses in the insert piece.

Alternatively, the free ends of the limbs of the U of the locking element can also be guided in the area of the pivot axis of the tongue of the over-center mechanism, the design being then arranged such that the pivot pins mounting the tongue pivotingly in the insert piece pass through bearing bores in the ends of the limbs of the locking element. In contrast to the previously mentioned longitudinally displaceable arrangement, the locking element is then guided pivotingly in this case, but in both cases so as to be displaceable in a specific manner on the insert piece. The last-mentioned pivoting guidance of the locking element permits leverage of the force of the spring, in that the locking projections are disposed on a shorter lever arm with respect to the pivot axis than the spring. The snap-in force or holding force is then increased with respect to the effective lever lengths.

The invention will be further explained in the following description of an embodiment thereof, in conjunction with the drawing, wherein:

FIG. 1 is a side elevational cross-sectional view taken through an inlet housing piece of a cabinet hinge, constructed in two pieces in accordance with the invention, as seen in the direction of the arrows 1—1 of FIG. 2;

FIG. 2 is a top view of the inlet housing shown in FIG. 1;

FIG. 6 is a cross-sectional view taken through the locking element holding the insert piece in the external housing piece, as seen in the direction of the arrows 6—6 of FIG. 7, and FIG. 7 is a top view of the locking element shown in FIG. 6.

Figure 3:
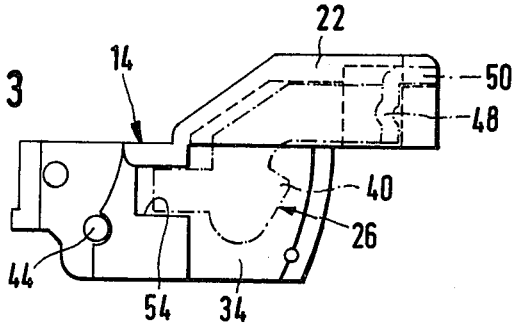
FIG. 3 is a side view of the insert piece of the inlet housing shown in FIGS. 1 and 2.
Figure 4:
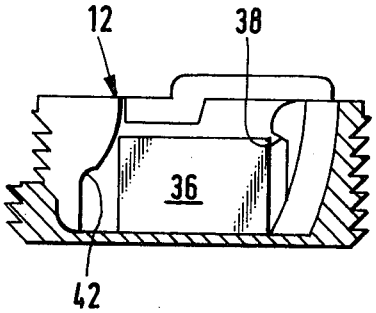
FIG. 4 is a cross-sectional view through the external housing piece of the inlet housing shown in FIGS. 1 and 2, as seen in the direction of the arrows 4—4 in FIG. 5.
Figure 5:
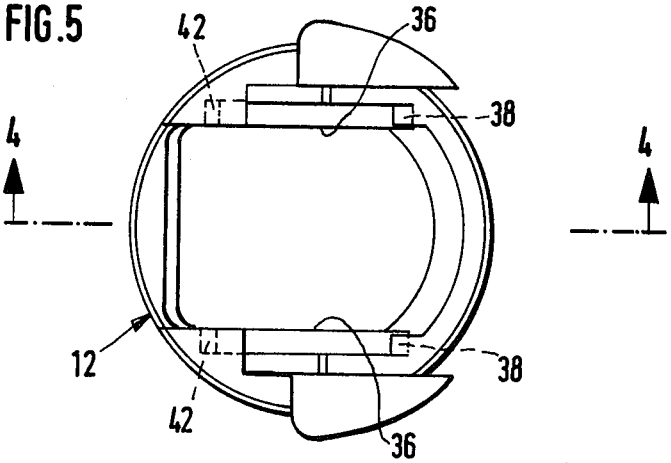
FIG. 5 is a top view of the housing piece shown in FIG. 4.

The inlet housing 10, shown in FIGS. 1 and 2, of a cabinet hinge is composed essentially of two main pieces, namely the cup-like external housing piece 12 which can be fastened by hammering or otherwise into a matching mortise 11 in a cabinet door 13, and of the insert piece 14 which can be inserted into the housing piece and can be locked in a particular position. The insert 14 is articulated in this case by means of two hinge links 16 and 18 so as to pivot on the supporting wall part of the hinge, which is not shown. The insert is provided with an over-center mechanism, which in this case is formed by a tongue 20 which is mounted so as to pivot at its bottom end in the insert 14 and has a slanting contact surface, which is biased into the illustrated position by a spring disposed in a recess in an upper housing section 22 of the insert 14. When the door equipped with the hinge of the invention is closed, the pivot eye at the supporting wall end (not shown) of the outer hinge link 18 comes into engagement with the slanting contact surface of tongue 20 and pushes tongue 20 rearwardly against the action of the spring 24 until a dead-center position is reached. When the dead-center position is passed, the tongue then forces the pivot eye into the final closed position. The construction of an over-center mechanism of this kind is, of itself, known in hinges having a one-piece inlet housing, and therefore does not need to be further explained herein. It is only to be pointed out that, instead of the linking of the insert to the supporting wall part of the hinge by means of links in the manner of a four-joint hinge, other methods of joining the door part to the supporting wall part of the hinge can be used, such as, for example, direct linking by means of a single pivot pin or by slide-guided linkage. Neither is it essential that the over-center mechanism have the construction shown. It is important only that it be an over-center mechanism equipped with a spring corresponding to spring 24, since this spring of the over-center mechanism is used in accordance with the invention simultaneously for the production of a locking or detent force acting on a locking means 26 (FIGS. 3, 6 and 7) whereby the insert 14 is locked in the external housing part 12.

The cup-like external housing piece 12 is of circular shape in plan and is provided on its outer circumferential surface with circumferential spines 28 arranged in the manner of a screw thread, which hold the housing piece 12 in the slightly undersized mortise 11 in cabinet door 13 (FIG. 1) after it has been driven into the said mortise. Instead of or in addition to the circumferential spines 28, the housing piece 12 can be fastened in the cabinet door 13 by means of sections which can be spread open, or by means of screws which can be installed in suitable fashion. In its interior, the housing piece 12 has the elongated shape illustrated, so that the insert piece 14 shown in FIG. 3 can be inserted into the external housing piece 12 so that its bottom portion 34 will fit matingly therein, i.e., will be secured against rotation. After the insert piece 14 has been placed in the external housing piece, all that remains projecting from the housing piece is the section 22 of insert piece 14 which accommodates the spring 24.

For the snap-fastening of the insert piece 14 in the housing 12, the latter is provided in its one end area at the opposite flat sides 36 with undercut snap fastening recesses 38 which can be engaged by the snap fastening projections 40 of the locking element 26 which will be further explained in conjunction with FIGS. 6 and 7. It is, of course, possible to reverse the arrangement of snap fastening projections and recesses, i.e., to provide projections on the housing piece 12 and matching recesses on the locking element means 26. Furthermore, the flat sides of the housing piece 12 are provided in the end area opposite the undercut snap fastening recesses with undercut recesses 42 which can be engaged by the ends of pin 44 (FIGS. 1 and 3) of the outer hinge link 18, which extend beyond the width of the insert piece 14, once the housing piece 12 and insert piece 14 are in the proper installation position. The pin 44 is thus used to serve a twofold purpose, namely as a pivot for the hinge link 18 and as a locking projection. Instead of the elongation of one hinge link pivot pin, or of two such pins if desired for reasons of strength, it is, of course, also possible to form corresponding projections on the insert piece 14.

In FIGS. 6 and 7 is shown the locking element 26 which is U-shaped in plan (FIG. 7) and stamped out of sheet metal. The inside width between the limbs 46 of the U is approximately the same as the width of the lower section 34 of the insert piece 14, i.e., the limbs of the U lie flatly against this section. The cross member 48 connecting the limbs of the U is inserted from underneath into the hollow interior of housing section 22 which accommodates the spring 24 of the over-center mechanism, and the end of the spring farthest from the tongue 20 rests against the cross member 48, so that the latter, and with it the entire locking element 26, is urged rightwardly in the drawing (FIG. 1, for example). In the center of the cross member, a short tab 50 is formed, which is bent outwardly at right angles, and which engages a matching cutaway 52 in the rearward or outer end of the otherwise closed end wall of the housing section 22. This tab 50, which is carried in the cutaway (FIGS. 1 and 2), is thus externally accessible at its free end, so that it can be pushed back with a screwdriver or other such tool against the action of the spring 24, towards the interior of the housing section 22. At a slight distance from the cross member 48, the limbs 46 of the U run at first slantingly downward to approximately half of the height of section 34 of the insert 14. At this level, each limb is joined by short, horizontally disposed end sections 53 which are carried in a longitudinally displaceable manner in mating, outwardly open, flat recesses 54 (FIG. 3). On the edge opposite the end sections 53, i.e., projecting in the same direction as the tab 50, and at the same level as the end sections, the previously mentioned catch projections 40 are provided on the limbs of the U, for cooperation with the catch recesses 38 in the external piece housing 12. When the insert 14 is inserted into the housing piece 12, the insert piece will therefore first be introduced by its front end, i.e., the left end in the drawing, slantingly into the external housing piece, so that the projecting ends of the pivot pin 44 will engage the undercut recesses 42. Then the right end of the insert piece is forced into the interior of the housing. The slanting bottom edges of the catch projections 40 will then come into contact with the walls provided above the catch recess 38. As the insert 14 is increasingly forced into the housing, the locking element will therefore slide rearwardly until the correct installation position of both housing pieces is reached, in which the catch projections 40 of the locking element 26 and the catch recess 38 are in line and are forced into engagement with one another by the spring 24. The insert 14 is then matingly caught in the housing piece 12 and can be removed therefrom only if the locking element 26 is pushed leftwardly against the force of the spring 24 and removed from the housing by the reversal of the above-described installation steps.

On account of the quadruple mating lock provided at the two extended pivot pin ends and at the catch projections, a flawless, rigid fastening of insert piece 14 in housing piece 12 is achieved which is capable of withstanding great stress. For the first time, therefore, a two-piece inlet housing for cabinet hinges containing an over-center mechanism is created, the spring, which is necessary in any case for the over-center mechanism, serving simultaneously to provide the force for holding or catching the locking element.

It is clear that modifications and improvements are possible within the scope of the invention. Thus, for example, the locking element can be pivoted on the insert piece 14 instead of being longitudinally displaceable as described. The pivot pin 56, which is slightly extended at both ends and which is necessary in any case for the tongue 20 of the over-center mechanism, can then serve as the pivot axis. Since the catch projections on the limbs of the U serving as the lever in this case are provided at approximately half of the height, while the spring force is applied at the level of the cross member 48, i.e., engages a considerably longer effective lever arm, the holding force is increased in comparison to the spring force by the ratio of the effective lever arms. In practice, however, it has been found that such leverage is not necessary since the force of the springs required for over-center mechanisms suffices for the secure locking together of the two parts of the recessed housing without the need for leverage.

I claim:

1. A cabinet hinge having a supporting wall part and a two-piece door part which is constructed as an inlet housing having an outer, cup-shaped housing piece adapted to be fastened in a mating inlet in a cabinet door and having at least one recess, and a separate insert piece adapted to be fitted into the outer housing piece and snap-fastened therein and which is pivotingly linked to said supporting wall part, an over-center mechanism integrated in said insert piece and formed of a spring-biased tongue cooperating with a counter-surface, a spring mounted in the insert piece and pretensioning said tongue, a locking element engaged by the extremity of the spring remote from the tongue, said locking element being displaceably mounted at the insert piece and provided with at least one catch projection means which, when the insert piece is in its proper position in the outer housing piece, catches in said at least one recess.

2. A cabinet hinge according to claim 1, wherein said catch projection means comprises two projections.

3. A cabinet hinge according to claim 1, comprising two hinge links in the manner of a four-point linkage articulating the insert piece to the supporting wall part, pivot pins holding the hinge links on the door part side of the hinge, at least one of said pivot pins being made of such length that its extremities project slightly from the insert piece on both sides, said outer housing piece having undercut recesses which receive the projecting ends when the insert piece is in the correct position in the outer housing piece.

4. A cabinet hinge according to claim 1, wherein said locking element is stamped from sheet metal and has an approximate U shape in plan, with limbs and a cross member joining the limbs, the limbs being carried in flat engagement with the insert piece, while the spring of the over-center mechanism engages the cross member, the catch projection means being formed on the limbs and pointing in the direction of the force of the spring acting on the locking element.

5. A cabinet hinge according to claim 4, comprising a relatively short tab bent over at approximately right angles and formed on the cross member of the locking element, said tab being guided in a recess in the insert piece, which last mentioned recess is open at least adajcent the free end of the tab for engagement by a tool, whereby the locking element can be pushed rearwardly against the action of the spring.

6. A cabinet hinge according to claim 4, wherein flat recesses are provided in the insert piece and wherein the free ends of the limbs of the U of the locking element are guided longitudinally displaceably in said flat recesses.

7. A cabinet hinge according to claim 4, wherein said tongue has a pivot axis, a pivot pin mounting the tongue pivotingly in said insert piece, the free ends of the limbs of the U of the locking element being guided in the vicinity of the pivot axis of the tongue of the over-center mechanism, said pivot pin passing through bearing bores in the ends of the limbs of the locking element.

* * * * *